United States Patent [19]

Bacon et al.

[11] Patent Number: 4,499,704

[45] Date of Patent: Feb. 19, 1985

[54] CORRUGATED BOX FORMING, LOADING AND SEALING MACHINE

[75] Inventors: Forrest C. Bacon, Invergrove Heights; Keith W. Nord, Stillwater, both of Minn.

[73] Assignee: Ex-Cell-O Corporation, Troy, Mich.

[21] Appl. No.: 542,921

[22] Filed: Oct. 13, 1983

[51] Int. Cl.[3] ..... B65B 35/54; B65B 47/10; B65B 49/08

[52] U.S. Cl. ..... 53/156; 53/207; 53/374; 53/383; 493/84; 493/114; 493/151

[58] Field of Search ..... 53/156, 157, 207, 208, 53/374, 377, 383, 387, 462, 566; 493/84, 102, 114, 151, 167, 174

[56] References Cited

U.S. PATENT DOCUMENTS

| | | | |
|---|---|---|---|
| 3,332,207 | 7/1967 | Midnight | 53/207 |
| 3,782,071 | 1/1974 | Hagedorn | 53/207 |
| 4,023,471 | 5/1977 | Royal | 493/167 |
| 4,463,541 | 8/1984 | Nowacki | 53/207 |

*Primary Examiner*—Robert L. Spruill

*Assistant Examiner*—Richard M. Mudd

*Attorney, Agent, or Firm*—John P. Moran

[57] ABSTRACT

A corrugated box forming, loading and sealing machine, including a first or magazine and infeed section, a second or forming and loading section, and a third or closing and discharge section. In the first section there is stored and fed one-at-a-time flat corrugated blanks consisting of bottom, front, back and two top-half panels, all with extended edge panels, while glue is applied to the bottom, front and back edge panels. In the second section a product, such as cartons or plastic bottles, and two side panels, are loaded from opposite sides onto the bottom panel. When full, the loaded bottom panel is lowered through an opening whose four edge portions cause the front and back panels, and their respective edge panels to wrap around the product. The resultant open-topped box is then pushed into the third section while glue is applied to the side panels, and the two top-half panels are urged downwardly onto the product, and their edge panels into contact with the glued side panels, to thus complete the sealing process prior to discharge.

5 Claims, 12 Drawing Figures

CORRUGATED BOX FORMING, LOADING AND SEALING MACHINE

TECHNICAL FIELD

This invention relates generally to box forming machines and, more particularly, to such machines for forming, loading and sealing boxes commonly referred to as "Bliss" boxes.

BACKGROUND ART

While there are a variety of satisfactory box forming machines available today, it is desirable to provide an improved, efficient, compact, and economical machine for forming corrugated boxes from three-piece blanks and including cooperating facilities for loading a product into the boxes prior to sealing the top closure thereof.

DISCLOSURE OF THE INVENTION

Accordingly, a general object of the invention is to provide an improved, efficient, compact and economical machine for forming, loading and sealing three-piece boxes known as Bliss boxes.

Another object of the invention is to provide an improved box forming, loading and sealing machine, including a magazine and infeed section for flat corrugated blanks; a middle section for forming blanks into an an open-top box including two side panels, and loading one or more rows of a selected container-type product therein; and a discharge section wherein the top panels are closed and sealed, and the closed box discharged.

A further object of the invention is to provide a three-piece corrugated box forming, loading and sealing machine, including magazines for a wrap-around body blank and two side panel blanks; means for loading a product and the two side panel blanks onto the bottom panel portion of the body blank; glue guns for applying glue to selected edge portions of the body blank; means for lowering the loaded bottom panel through an opening to thereby cause the body blank to wrap-around the two ends of the product load and the glued selected edge portions to contact and become sealed against the side panel blanks; additional glue guns for applying glue to the upper edge portions of the side panel blanks; and means for folding the top panel portion of the body blank onto the product and to seal same to the side panel blanks to complete the sealing of the box.

Still another object of the invention is to provide a box forming, loading and sealing machine including a first magazine for holding stacked, longitudinally oriented, flat blanks, each having bottom, front, rear, and two top half panel segments, with narrow edge portions extending from both sides of each segment, all such segments and edge portions being interconnected by score lines; vacuum lift means for lifting each top blank in the magazine; a first pusher for pushing each lifted blank to a central station while receiving glue on the upper surfaces of the narrow edge portions of the bottom, front and back panel segments from overhead glue guns; support fingers for supporting the bottom panel segment in an opening in the central station; oppositely disposed second and third, spring-loaded magazines for holding side panel blanks in a vertical attitude just above the narrow edge portions of the bottom panel segment; a pair of vertical blades for peeling-off the innermost side panel blanks and urging them downwardly to a location adjacent aligned product in parallel tracks; oppositely disposed, second and third pushers programmed to push one or more rows of the product, along with the side panel blanks, from the parallel tracks onto the bottom panel segment; means for lowering the covered bottom panel segment through the opening which is sized to accommodate the bottom panel segment to thereby cause the front and rear panel segments to bend into a vertical attitude against the product while the glued edge portions contact the side panels to become sealed thereto; a fourth pusher for first flattening the trailing top half panel segment, and then pushing the box forward while the upper portions of the side panels are sprayed with glue from side oriented glue guns and urged into contact with a stationary rail which causes the front top half panel to be flattened on top of the box as the box passes thereunder; and pivotable arms for causing the edge portions of the two top half panel segments to be flattened onto the side panels in contact with the glue thereon, to wait being pushed out of the discharge section by the next on-coming box.

These and other objects and advantages of the invention will be apparent when reference is made to the following description and accompanying drawings.

BEST DESCRIPTION OF THE DRAWINGS

BEST MODE OF CARRYING OUT THE INVENTION

Figure 1:
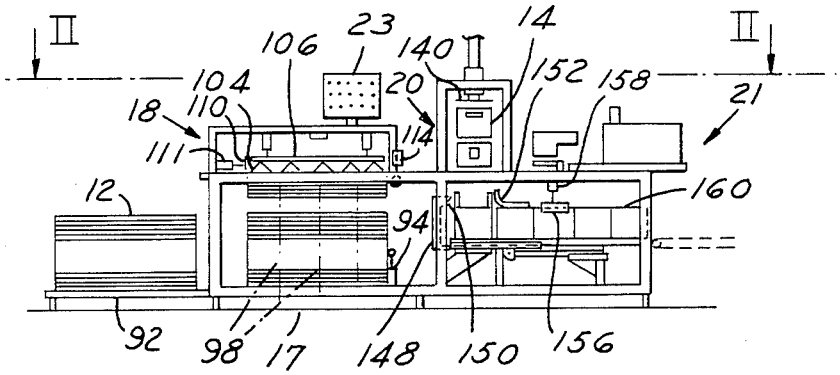
FIG. 1 is a side elevational view of a forming, loading and sealing machine embodying the invention.
Figure 2:
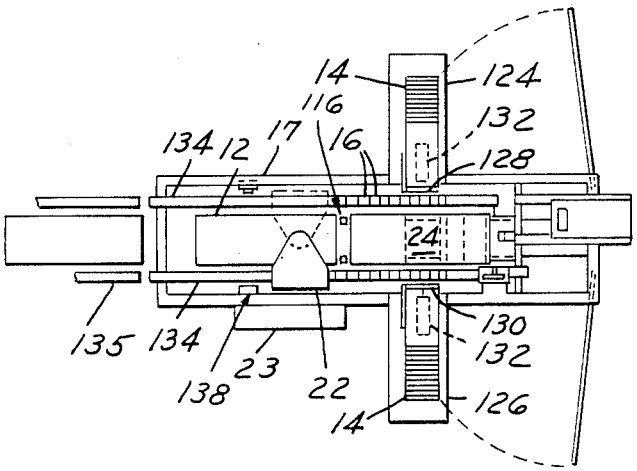
FIG. 2 is a top view taken along the plane of the line 2—2 of FIG. 1, and looking in the direction of the arrows.

Referring now to the drawings in greater detail, FIGS. 1 and 2 illustrate a corrugated box forming, loading and sealing machine 10 for forming the body blank 12 and two side panel blanks 14 (FIGS. 3 and 4) into an open-top box, while loading the box with a selected number and size of a product 16, such as filled paperboard containers or plastic bottles, prior to closing and sealing the top of the box.

The machine 10 includes a frame 17 supporting a magazine and infeed section 18 wherein the body blank 12 is fed into the machine; a forming and loading section 20 wherein the side panels 14 are installed and the product 16 loaded; a discharge section 21 wherein the top is closed and sealed; and a pair of control panels 22 and 23, one of which (control panel 22) is shown as being pivotable from one side of the machine 10 to the other, to accommodate the operator.

Figure 3:
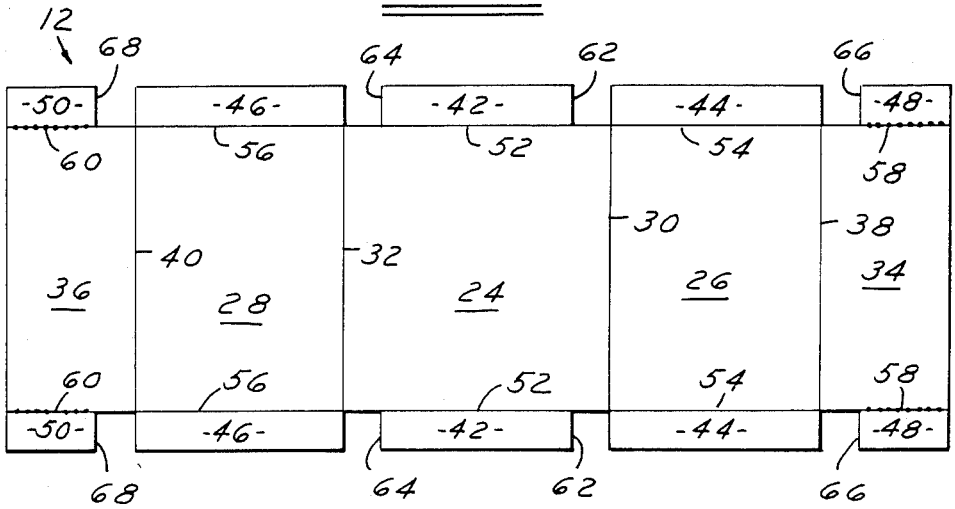
FIG. 3 is a plan view of the inside surface of a wrap-around corrugated cardboard body blank used in the invention.
Figure 4:
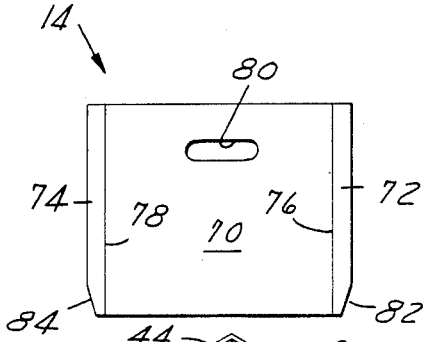
FIG. 4 is a side elevational view of a side panel blank used in conjunction with the body blank of FIG. 3.

As shown in FIG. 3, the body blank 12 which is fed into the infeed section 18 includes a central bottom panel 24 intermediate front and back panels 26 and 28, separated therefrom by respective score lines 30 and 32, and two top half panels 34 and 36, separated from the front and back panels by score lines 38 and 40. Pairs of edge panels 42, 44, 46, 48 and 50 are connected to the sides of the bottom, front, back, and two top half panels 24, 26, 28, 34 and 36, respectively, by pairs of score lines 52, 54, 56, 58 and 60. A pair of notches 62 and 64 are formed on the ends of each of the edge panels 42, and single notches 66 and 68 are formed on the inner edge of the respective top edge panels 48 and 50. Each side panel blank 14 (FIG. 4) includes a side panel 70 and edge panels 72 and 74 separated by respective score lines 76 and 78, and may, if desired, include a hand-hold opening 80 formed in the upper center of the side panel 70. Chamfers 82 and 84 are formed on the bottom corners of respective edge panels 72 and 74.

Figure 6A:
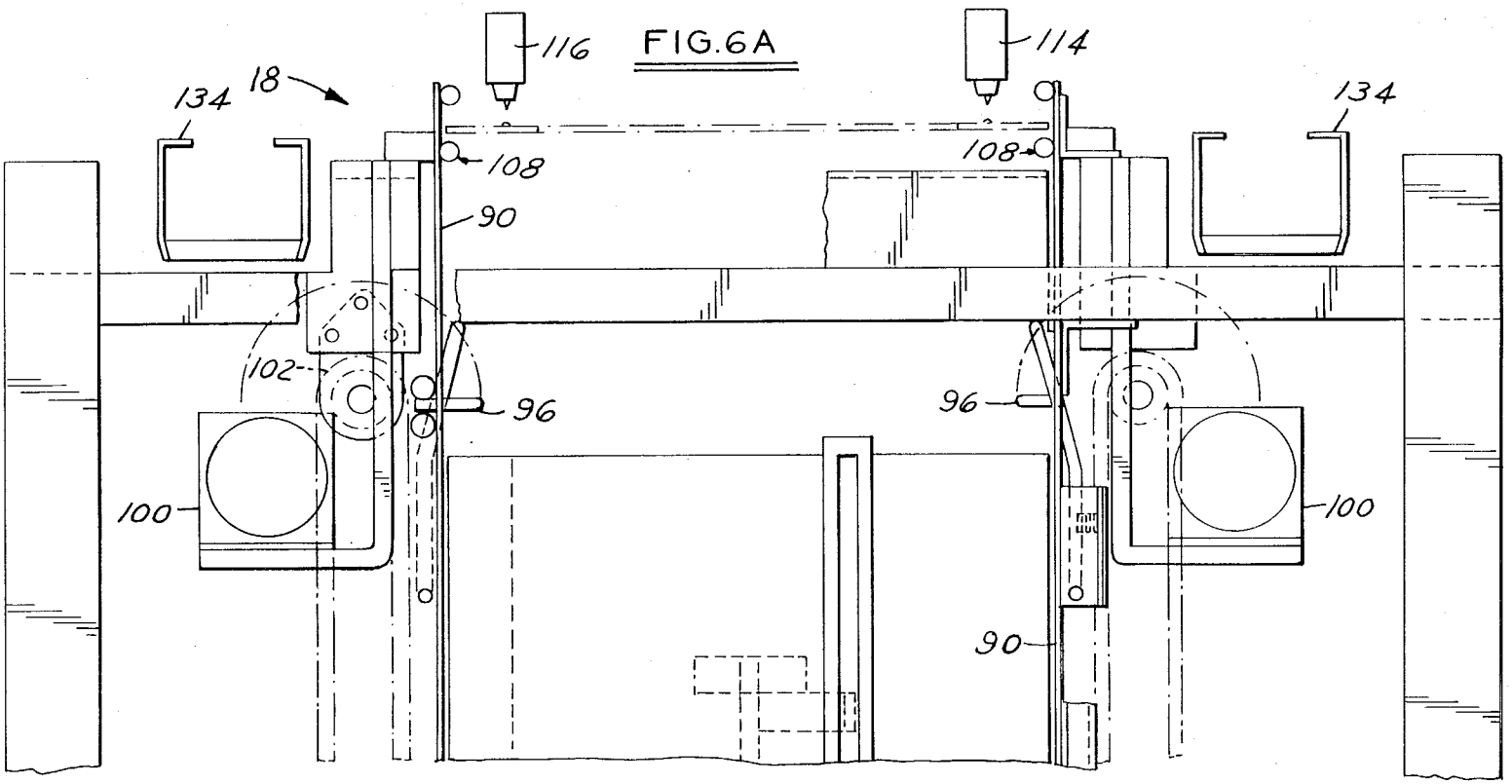
FIGS. 6–11 are fragmentary side elevational views of various detailed operational components of the FIG. 1 structure.
Figure 6B:
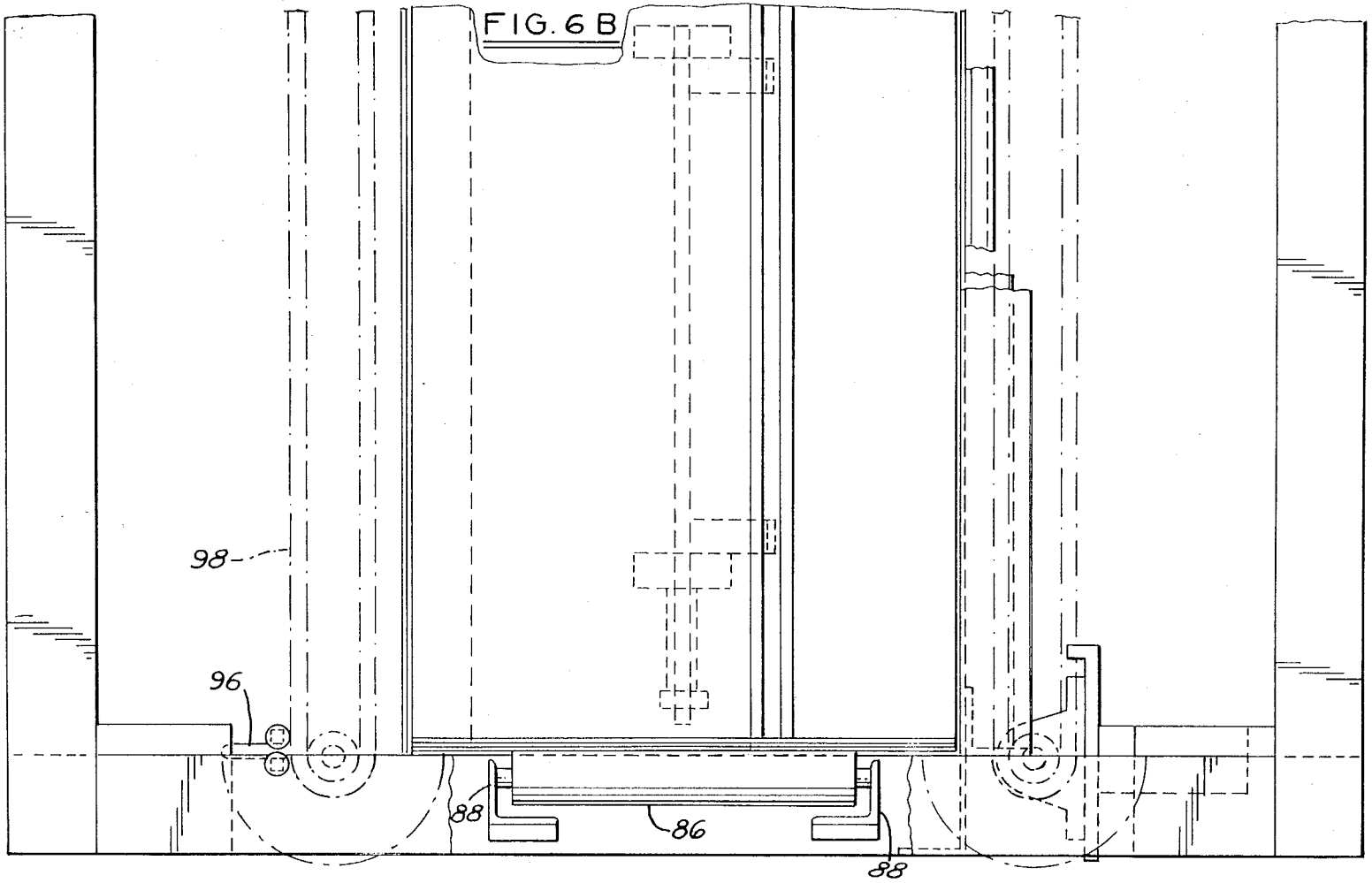
Figure 8:
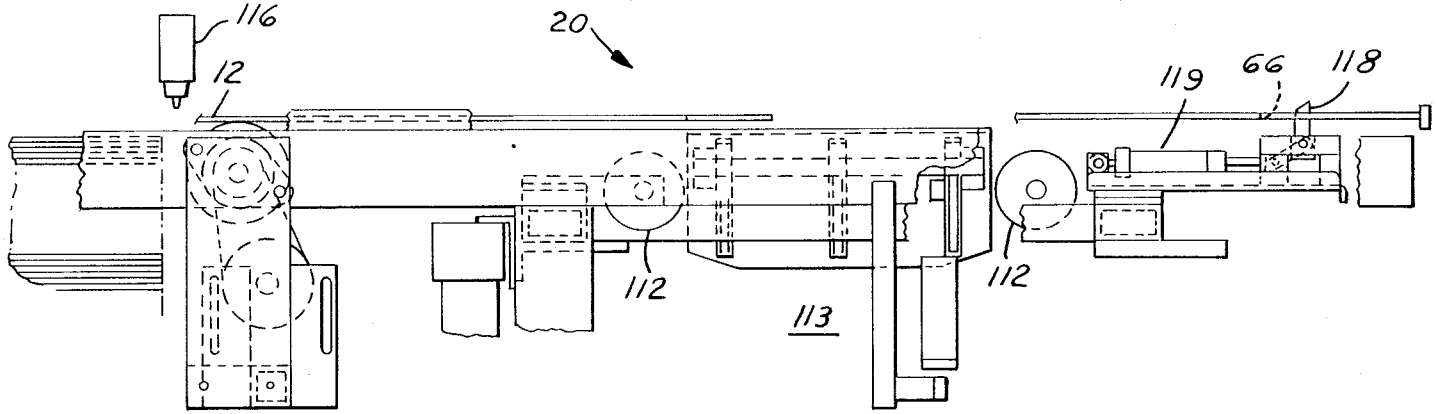

Referring once again to the machine 10 shown in FIGS. 1 and 2, the magazine and infeed section 18 thereof is shown in FIGS. 6A and 6B, and includes a series of rollers 86 rotatably mounted between side rails 88 and forming the bottom of the magazine section 18 between oppositely disposed fixed side walls 90. A stack of body blanks 12 may be fed onto the rollers 86 of the magazine section 18 via an external conveyor 92 (FIG. 1), engaging an infeed switch represented as 94 in FIG. 1. As a result, the stack is progressively lifted by dogs 96 (FIGS. 6A and 6B) mounted 180° apart on each of three endless chains 98 along each side wall 90, and driven by electric motors 100 (FIG. 6A) around upper and lower sprockets 102, to maintain the top blank in a predetermined position just below a plurality of suction cups 104 (FIG. 1) mounted on a vacuum gripping bar 106. The suction cups 104 serve to lift the uppermost body blank 12 so as to drag the edge panels 42, 44, 46, 48 and 50 (FIG. 3) past a pair of parallel rails 108 (FIG. 6A), bending slightly about the score lines 52, 54, 56, 58 and 60, to thereby cause the release of any additional blanks 12 which tend to be lifted with the uppermost blank. The latter blank is then released on top of the rails 108 to facilitate being pushed forward by a pusher 110 (FIG. 1) driven by an air cylinder 111, to a position just above and across two spaced rollers 112 (FIG. 8) forming the leading and trailing edges of an opening 113 therebetween at approximately the center of the forming and loading section 20. It is during this movement of the blank 12 that oppositely disposed, overhead glue guns 114 and 116 intermittently spray glue onto the upper surfaces of each of the rows of edge panels 42, 44 and 46. At the end of the pusher 110 stroke, a pair of hooks 118 (FIG. 8) driven by an air cylinder 119, are thereupon caused to enter the oppositely disposed, leading notches 66, to pull the body blank 12 into loading position, i.e., with the bottom panel 24 positioned directly over the opening 113 between the rollers 112, beneath the oppositely disposed inner edges of spaced support plates 120 and 122. Oppositely disposed, radiused sheet steel shoes 123 define the sides of the opening 113 between the spaced rollers 112.

Figure 7:
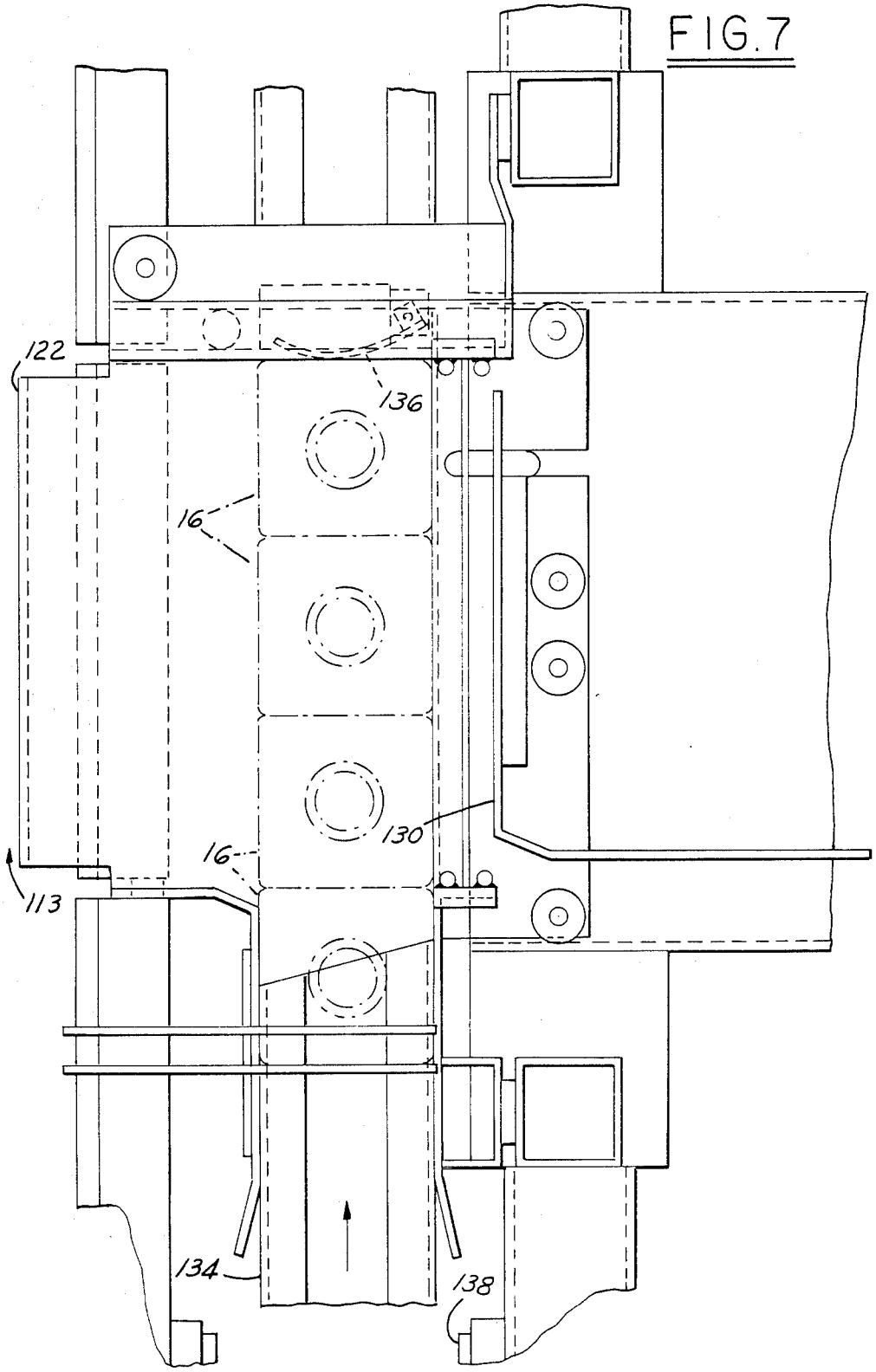

As shown in FIG. 2, oppositely disposed, spring-loaded magazines 124 and 126 each include a plurality of vertically oriented side panel blanks 14, stacked so as to have the bottom edges thereof between the chamfers 82 and 84 (FIG. 4) pointed downwardly. A pair of oppositely disposed pushers 128 and 130 (FIGS. 2 and 7), each driven by an air cylinder 132, are positioned below the respective magazines 124 and 126, and just outside a designated number of the container products 16 at the front ends of a pair of parallel conveyor tracks 134. The latter may be fed via external conveyors, represented as 135. The parallel tracks 134, incidently, may enter the machine 10 either from the infeed end thereof as shown, or from the discharge end (not shown).

The respective support plates 120 and 122 are located underneath and inwardly of the designated number of products 16. The leading container product 16 in each track 134 abuts against and closes a switch 136. A photoelectric unit 138 is positioned at a selected point upstream along each conveyor track 134. Once both switches 136 are closed and so long as the beams of both photoelectric units 138 are broken by container products 16, when a number of even rows, more than two, of aligned products are required for a particular box application, the pushers 128 and 130 are programmed to successively push, via short pushes, the designated number of products 16 onto the respective support plates 120 and 122, thereby progressively causing the bottom panel 24 to become covered with product.

Each successive push is a short push until only two more rows remain in order to fill the entire area of the bottom panel 24 (FIGS. 2 and 3). At this point, a program-controlled pair of vertical blades 140 (FIG. 1) are caused to descend to peel-off each innermost side panel blank 14 from the respective magazines 124 and 126, to a position intermediate the respective pushers 128 and 130 and their adjacent designated number of container products 16, whereupon the pushers 128 and 130, via a long stroke now, push opposite side panel blanks 14 and products 16 completely across the respective support plates 120 and 122 and onto the bottom panel 24, pushing the previous rows into the center of the panel. As the side panel blanks 14 move forward, they are prevented from hanging-up or jamming against the next-in-line container product 16 by virtue of edge panels 72 or 74 (FIG. 4) thereof being bendable about the score lines 76 or 78.

If an odd number of rows of product 16 are required to fill a particular bottom panel 24 area, then one or the other of the pushers 128 and 130 is programmed to be actuated first alone, after which they act in unison.

Figure 9:
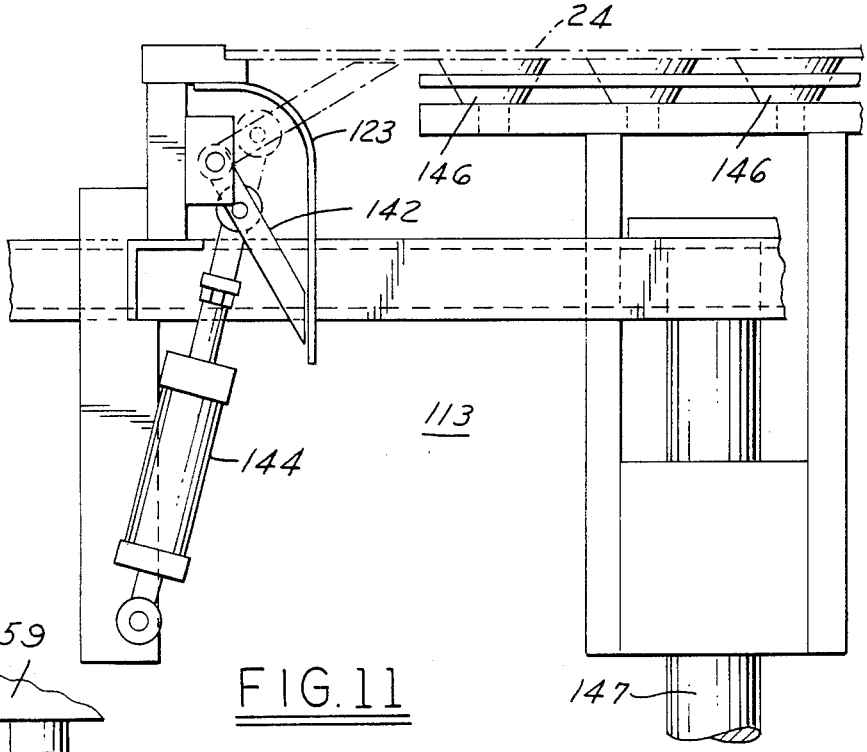

While being loaded with product 16, the bottom panel 24 portion of the body blank 12 is supported by six support fingers 142 (FIG. 9) operatively connected to air cylinders 144. Once a vacuum type gripper cup is raised by an air cylinder 147 into contact with the bottom panel 24, the cylinders 144 and 147 descend, allowing the bottom panel 24 under the weight of the rows of the product 16, in cooperation with the gripper cup 146, to lower through the opening 113.

Figure 5:
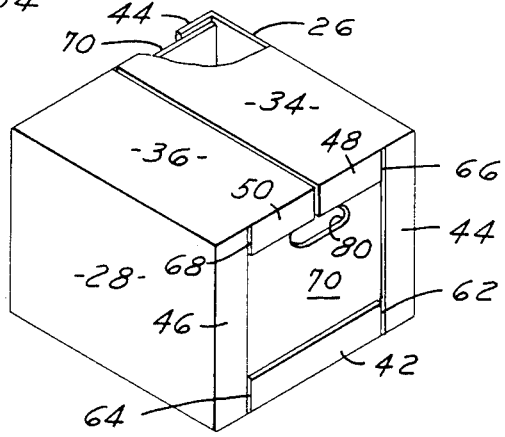
FIG. 5 is a perspective view of a completed box after being formed from the body and side panel blanks of FIGS. 3 and 4, loaded with product and sealed by the machine embodying the invention.

While the blanks 12 and 14, and the product 16, are descending, the front and rear panels 26 and 28 (FIG. 3) are being pushed upwardly by the rollers 112 (FIG. 8) in the opening 113, and the edge panels 42, 44 and 46 are being pushed upwardly by the radiused shoes 123 (FIG. 9) about the respective laterally oriented score lines 30 and 32, and the longitudinally oriented score lines 52, 54 and 56. Concurrently, the upwardly folding front and back panels 26 and 28 will first engage the chamfered edges 82 and 84 (FIG. 4) of the two side panel blanks 14, causing the latter to become perfectly centered with respect to the bottom panel 24. The previously glued edge panels 42, 44 and 46 will be caused to press against the respective edge portions of the respective side panel blanks 14, as shown in FIG. 5, to become secured thereto. As may also be noted in FIG. 5, the edge panels 44 and 46 are seen to fit into the notches 62 and 64 adjacent the edge panels 42.

Figure 10:
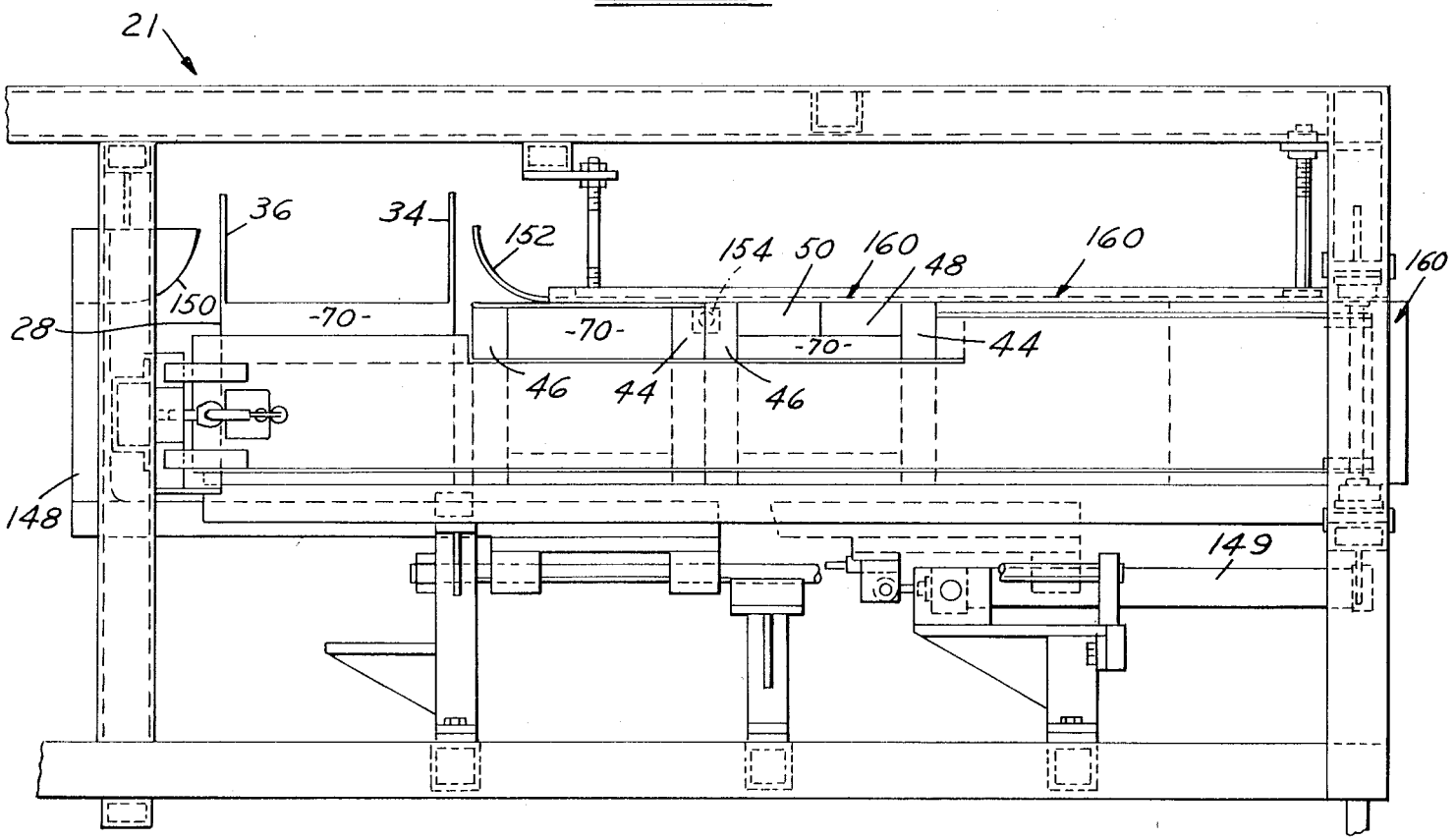

At this point, the top half panels extend directly upwardly from the respective front and back panels 26 and 28, with the edge panels 48 and 50 extending outwardly on the same plane therewith. A pusher 148 (FIGS. 1 and 10), driven by an air cylinder 149, including forwardly extending, arcuate-shaped forks 150 is then actuated, causing the forks 150 to first contact the trailing top half panel 36 (FIG. 10), bending it about the score line 40 into a horizontal attitude above the product 16 with the edge panels 48 and 50 still extending horizontally therefrom. The pusher 148 next engages the back panel 28, pushing the now partially formed box forward into the discharge section 21. As the latter moves forward, the leading top half panel 34 encounters a stationary, arcuate-shaped rail 152 (FIG. 10) which causes it to bend about the score line 38 to assume a horizontal attitude above the product 16 as it passes beneath the rail.

Figure 11:
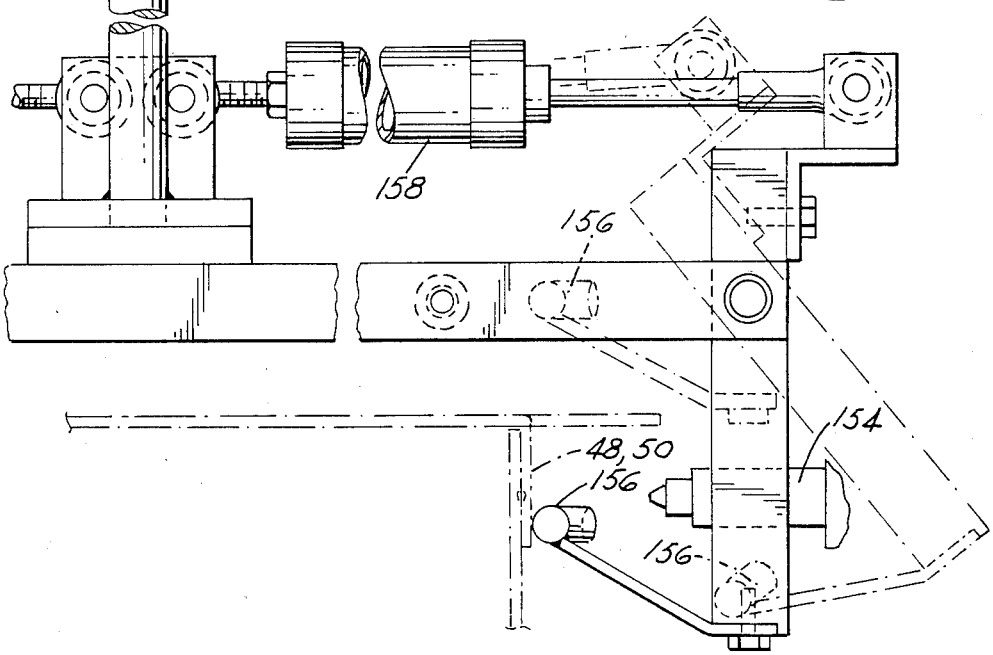

While the box is moving forward in the manner just described, a second pair of oppositely disposed glue guns 154 are energized to spray glue along the upper edge portions of the side panels 14 intermediate the respective edge panels 44 and 46 previously secured to the side panels. Oppositely disposed, pivotable arms 156 are moved downwardly from the dotted line position in FIG. 11 to the solid line position to engage the laterally extending edge panels 48 and 50, urging them downwardly about the respective score lines 58 and 60 to be secured by the glue against the side panels 14 intermediate the edge panels 44 and 46 which fill the spaces provided by the notches 66 and 68, as may be noted in FIG. 5, just above the respective hand-hold openings 80. The arms 156 are then pivotted outwardly by an air cylinder 158 in order to be raised up by an air cylinder 159 past the next on-coming extended edge panels 44 and 46, ready for the next cycle.

The control panels 22 and 23, mounted on supporting framework, house suitable control relays, solenoid valves, time delay units, electronic NC, CNC or DNC "software" controls, and the associated circuitry as required for the above described sequence of operations.

The thus formed, loaded and sealed box 160 (FIG. 10) is thereupon pushed by the next-in-line box out of the discharge section 21 onto any suitable conveyor (not shown).

INDUSTRIAL APPLICABILITY

It should be apparent that the invention provides an improved, efficient, compact and economical machine for forming boxes from three-piece blanks, loading selected products therein, and then sealing and discharging the packaged unit.

While but one embodiment of the invention has been shown and described, other modifications thereof are possible.

The embodiments of the invention in which an exclusive property or privilege is claimed are defined as follows:

1. A corrugated box forming, loading and sealing machine comprising a first magazine for storing body blanks in a horizontal flat attitude including bottom, front, back, two top half panels, and edge panels on opposite side edges of each of said bottom, front, back, and two top half panels; a loading station; oppositely disposed, spaced apart second and third magazines for storing side panel blanks in a vertical attitude on opposite sides of said loading station; an opening in said loading station; first pusher means for conveying one body blank at a time from said first magazine into said loading station such that said bottom panel of said body blank is above said opening; a first set of glue guns for applying glue to said opposite edge panels of said bottom, front and back panels; means for supporting said bottom panel of said body blank in said opening; parallel tracks for feeding a selected number of products in a line to a location adjacent opposite sides of said loading station; dual blade means for forcing the leading side panel blanks downwardly from said respective second and third magazines to a location immediately adjacent said products; second and third pusher means for pushing a predetermined number of rows of said selected numbers of aligned products onto said bottom panel of said body blank from opposite sides thereof and for pushing the respective lead side panel blanks with the last rows of products; means for lowering said supporting means, said bottom panel and said side panels in said opening once said bottom panel is completely covered with products, thereby causing said front and back panels to bend upwardly so as to contact said products and said glued edge panels to become sealed to said side panels to form a filled open-topped box; fourth pusher means for bending the rear top half panel onto the products and for pushing the box forward; stationary rail means for engaging and bending the front top half panel onto the products; and a second set of glue guns for applying glue to the upper edge portions of said side panel blanks; and pivotable arm means for urging said edge panels on said two top half panels downwardly into contact with said glued edge portions of said side panel blanks to complete the sealing of the box.

2. For forming a corrugated box from a body blank including bottom, front, back, two top half panels, and edge panels on opposite side edges of each of said bottom, front, back and two top half panels, and two side panel blanks, loading the box with a container-type product, and sealing the box, a machine comprising a first magazine for storing a stack of said body blanks in a horizontal flat attitude; a loading station; oppositely disposed, spaced apart second and third magazines for storing side panel blanks in a vertical attitude on opposite sides of said loading station; an opening in said loading station; means for conveying one body blank at a time from said stack in said first magazine into said loading station such that said bottom panel of said body blank is above said opening; a first set of glue guns for applying glue to said opposite edge portions of said body blank; means for feeding a designated number of rows of a selected number of products and a side panel blank from opposite sides of said loading station onto said bottom panel; supporting and lowering means for lowering said loaded bottom panel and said side panels, thereby causing said front and back panels to bend upwardly while entering said opening against said products and said glued edge panels to bend inwardly so as to become sealed to said side panels to form a filled open-topped box; fourth pusher means for bending the rear top half panel forward onto the products and for pushing said box forward; stationary rail means for engaging and bending the front top half panel rearward onto the products; and a second set of glue guns for applying glue to the upper edge portions of said side panel blanks intermediate said sealed front and back edge panels; means for urging said edge panels on said two top half panels downwardly into contact with said glued edge portions of said side panel blanks to complete the sealing of said box.

3. The machine described in claim 2, wherein said means for conveying one body blank at a time includes a vacuum gripping bar including a plurality of suction cups mounted above said stack of said body blanks for lifting the uppermost body blank from said stack, and an air cylinder-driven pusher for pushing said lifted body blank into position in said loading station.

4. The machine described in claim 2, wherein said means for feeding a designated number of rows of a selected number of products and a side panel blank includes a pair of support plates on opposite sides of said opening, a pair of cylinder-driven pushers operatively mounted below said respective second and third magazines adjacent said support plates, and a pair of blades for peeling-off each innermost side panel blank and positioning it between said respective pusher and said selected number of products, said pushers being programmed to push a designated number of rows of products onto said support plates, and when the last two rows remain to be filled, said blades are actuated to provide two side panel blanks for accompanying the last two rows of product which are then pushed by the pusher onto said bottom panel to load the entire area thereof.

5. The machine described in claim 2, wherein said means for urging said edge panels on said two top half panels downwardly into contact with said glued edge portions includes cylinder-driven, oppositely disposed, pivotable arms positioned for movement from just above said edge panels in a downward arcuate manner toward said glued edge portions.

* * * * *